US010323653B2

(12) United States Patent
Wang et al.

(10) Patent No.: US 10,323,653 B2
(45) Date of Patent: Jun. 18, 2019

(54) CENTRIFUGAL COMPRESSOR AND CENTRIFUGAL UNIT HAVING THE SAME

(71) Applicant: Gree Electric Appliances, Inc. of ZHUHAI, Zhuhai, Guangdong (CN)

(72) Inventors: Hongxing Wang, Zhuhai (CN); Zhiping Zhang, Zhuhai (CN); Ruixing Zhong, Zhuhai (CN); Nan Jiang, Zhuhai (CN); Rong Xie, Zhuhai (CN); Caiyun Jiang, Zhuhai (CN); Jianfei Liu, Zhuhai (CN); Yuhui Chen, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 423 days.

(21) Appl. No.: 15/103,942

(22) PCT Filed: Aug. 5, 2014

(86) PCT No.: PCT/CN2014/083752
§ 371 (c)(1),
(2) Date: Jun. 13, 2016

(87) PCT Pub. No.: WO2015/135282
PCT Pub. Date: Sep. 17, 2015

(65) Prior Publication Data

US 2016/0319839 A1 Nov. 3, 2016

(30) Foreign Application Priority Data

Mar. 12, 2014 (CN) ..... 2014 1 0091344

(51) Int. Cl.
*F04D 29/42* (2006.01)
*F04D 29/46* (2006.01)
(Continued)

(52) U.S. Cl.
CPC ..... *F04D 29/462* (2013.01); *F04D 17/122* (2013.01); *F04D 27/002* (2013.01);
(Continued)

(58) Field of Classification Search
CPC .... F04D 29/462; F04D 17/122; F04D 27/002; F04D 27/0284; F04D 29/284; F04D 29/464
See application file for complete search history.

(56) References Cited

U.S. PATENT DOCUMENTS 3,362,624 A * 1/1968 Endress ..... F04D 27/0215 415/1
4,295,792 A * 10/1981 Tachibana ..... F04D 25/02 192/48.614
(Continued)

FOREIGN PATENT DOCUMENTS

CH 125547 4/1928
CN 1321225 A 11/2001
(Continued)

OTHER PUBLICATIONS

Russia Patent Office (FIPS), Office action dated Jan. 30, 2018 regarding the counterpart Russia patent application of the present application.
(Continued)

*Primary Examiner* — P. Macade Nichols
(74) *Attorney, Agent, or Firm* — Li & Cai Intellectual Property (USA) Office

(57) ABSTRACT

The invention discloses a centrifugal compressor. The centrifugal compressor includes multiple stages of compression units which are communicated in sequence. Each stage of compression unit includes a diffusion cavity (1) and a diffusion adjustment device, wherein the diffusion adjustment device includes a movable member (21) configured to
(Continued)

change a radial flow area of the diffusion cavity (1) provided in correspondence thereto, the movable member (21) being movably provided in an axial direction of the centrifugal compressor. The invention also discloses a centrifugal unit having the centrifugal compressor. The movable member of each stage of compression unit of the centrifugal compressor changes the radial flow area of the diffusion cavity of this stage of compression unit, thereby effectively reducing the possibility of surging.

12 Claims, 2 Drawing Sheets

(51) Int. Cl.

| | |
|---|---|
| ***F04D 17/12*** | (2006.01) |
| ***F04D 27/00*** | (2006.01) |
| ***F04D 29/28*** | (2006.01) |
| ***F04D 27/02*** | (2006.01) |

(52) U.S. Cl.
CPC ..... *F04D 27/0284* (2013.01); *F04D 29/284* (2013.01); *F04D 29/464* (2013.01); *F05D 2250/51* (2013.01); *F05D 2250/52* (2013.01)

(56) References Cited

U.S. PATENT DOCUMENTS 4,460,310 A * 7/1984 Plunkett ..... F01D 17/143 415/158
4,969,798 A * 11/1990 Sakai ..... F04D 27/0246 415/150

FOREIGN PATENT DOCUMENTS

| | | | |
|---|---|---|---|
| CN | 2536821 | Y | 2/2003 |
| CN | 201330717 | Y | 10/2009 |
| CN | 103261701 | A | 8/2013 |
| CN | 203730350 | U | 7/2014 |
| EP | 1117934 | B1 | 8/2004 |
| EP | 1643133 | A1 | 4/2006 |
| GB | 305214 | | 2/1928 |
| JP | 2011043130 | A | 3/2011 |
| RU | 2395726 | C1 | 7/2010 |
| SU | 211012 | | 2/1968 |

OTHER PUBLICATIONS

European Patent Office, European Patent Search Report dated Oct. 6, 2017 regarding the counterpart European patent application of the present application.

* cited by examiner

CENTRIFUGAL COMPRESSOR AND CENTRIFUGAL UNIT HAVING THE SAME

TECHNICAL FIELD OF THE INVENTION

The invention relates to the field of refrigerating devices, and in particular to a centrifugal compressor and a centrifugal unit having the same.

BACKGROUND OF THE INVENTION

For a centrifugal unit, when a running load is reduced, inlet guide blades of a centrifugal compressor are closed gradually, and an air suction quantity is decreased. Suppose a passage area of a diffusion cavity remains unchanged, a flow velocity of air is decreased. When the flow velocity of the air cannot overcome a resistance loss of the diffusion cavity, an airflow will stop. Due to the reduction of kinetic energy of the air, converted pressure energy will be reduced accordingly. When an air pressure is smaller than an exhaust pressure, the airflow flows backwards, and surging is caused. For a single-stage centrifugal compressor, in order to prevent a centrifugal compressor from surging, a diffusion cavity adjustment device and an adjustment mechanism are often linked to act on an outlet of an impeller. When the running load is reduced, the flow velocity of the air can be increased by decreasing the passage area of the diffusion cavity, thereby effectively preventing the centrifugal compressor from surging. For a multi-stage centrifugal compressor, in order to improve the efficiency, an economizer generally exists between every two stages, and therefore an air supply opening exists. If a single movable diffusion cavity adjustment device is used for example, when the centrifugal compressor surges, a surging phenomenon will be improved only at a first stage having an adjustment function since only a single-stage impeller outlet diffusion cavity has the adjustment function while other stages do not have this function, and the surging phenomenon cannot be overcome at each of the other stages yet. If any stage of the multi-stage centrifugal compressor surges, normal working of an entire machine will be influenced, the centrifugal compressor is seriously destroyed, the performance of the centrifugal compressor obviously deteriorates, the noise is increased, vibration of the entire unit is greatly aggravated, and the running reliability of the unit is seriously influenced.

SUMMARY OF THE INVENTION

The invention aims to provide a centrifugal compressor and a centrifugal unit having same, which are intended to reduce the possibility of surging of any one of multiple stages of compression units of the centrifugal compressor.

In order to achieve the aim, the invention provides a centrifugal compressor, which comprises multiple stages of compression units communicated in sequence. Each stage of compression unit comprises: a diffusion cavity; and a diffusion cavity adjustment device, the diffusion cavity adjustment device comprising a movable member configured to change a flow area of the diffusion cavity provided in correspondence thereto, and the movable member being movably provided in an axial direction of the centrifugal compressor.

Furthermore, each stage of diffusion cavity adjustment device may further comprises: a transmission rod, the transmission rod being in drive connection with the corresponding movable member; and a guide structure, fixedly connected with a cavity wall of the corresponding diffusion cavity, the transmission rod being movably provided in the axial direction of the centrifugal compressor with respect to the guide structure.

Furthermore, each stage of diffusion cavity adjustment device further comprises a reset mechanism configured to move the corresponding movable member to make the flow area of the corresponding diffusion cavity in a maximum state.

Furthermore, each diffusion cavity is enclosed by a first cavity wall and a second cavity wall, the first cavity wall and the second cavity wall being provided at an interval, and each guide structure comprises a bushing arranged at the periphery of the corresponding transmission rod in a sleeving manner, the bushing being fixed inside an accommodating hole provided at the corresponding first cavity wall.

Furthermore, each reset mechanism comprises: a baffle, connected with an end of the corresponding transmission rod; and a spring, arranged at a periphery of the corresponding bushing in a sleeving manner. Each accommodating hole on the corresponding first cavity wall comprises a first segment adapting to the corresponding bushing and a second segment adapting to the corresponding spring, the spring being located between a step surface, connecting the first segment and the second segment, and the corresponding baffle.

Furthermore, each movable member comprises a circular ring, an axis of the centrifugal compressor serving as a centre. A groove adapting to each circular ring is provided at the corresponding first cavity wall; and each accommodating hole has an opening which is provided at a bottom of the corresponding groove and allows the penetration of the corresponding transmission rod.

Furthermore, an accommodating slot is provided at an inner circumferential surface of each bushing. Each guide structure further comprises a supporting belt provided in the corresponding accommodating slot, the supporting belt being matched with the corresponding transmission rod slidably.

Furthermore, each guide structure comprises at least one guide ring coaxial with the corresponding transmission rod.

Furthermore, each reset mechanism comprises: a baffle, connected with an end of the corresponding transmission rod; and a spring, arranged outside the corresponding transmission rod in a sleeving manner and provided between the baffle and the guide ring adjacent to the baffle.

Furthermore, each diffusion cavity is enclosed by a first cavity wall and a second cavity wall, the first cavity wall and the second cavity wall being provided at an interval. A accommodating hole is provided at the corresponding first cavity wall, and an outer circumferential surface of at least one guide ring is connected with an inner circumferential surface of the corresponding accommodating hole.

Furthermore, each movable member is annular. A groove adapting to each movable member is provided at the corresponding first cavity wall. Each accommodating hole has an opening which is provided at a bottom of the corresponding groove.

Furthermore, the centrifugal compressor further comprises: an air inlet; a plurality of inlet guide blades, provided at the air inlet; a drive device, the drive device being in drive connection with the inlet guide blades; and a plurality of transmission shafts, each of the transmission shafts being in drive connection with the drive device respectively, and the transmission shafts being in drive connection with the inlet guide blades in a one-to-one correspondence manner. The transmission rod of the compression unit closest to the air inlet being in transmission connection with one of the corresponding transmission shafts, and the transmission rod of each of the remaining stages of compression units being in transmission connection with the movable member of the previous stage of compression unit.

Furthermore, the centrifugal compressor further comprises at least one drive wheel, the drive wheel sleeves the corresponding transmission shaft and is provided in correspondence to one transmission rod.

Furthermore, the drive wheel is a cam or an eccentric bearing. A first end of the corresponding transmission rod of the drive wheel abuts against an outer circumferential surface of the drive wheel. A second end of the corresponding transmission rod of the drive wheel is connected with the corresponding movable member.

According to another aspect of the invention, a centrifugal unit is also provided, which comprises an above-mentioned centrifugal compressor.

By means of the technical solutions of the invention, the centrifugal compressor comprises multiple stages of compression units which are communicated in sequence, each stage of compression unit comprises the diffusion cavity and the diffusion cavity adjustment device, the diffusion cavity adjustment device comprises the movable member configured to change the radial flow area of the diffusion cavity arranged in correspondence thereto, and the movable member is movably provided in the axial direction of the centrifugal compressor. By means of the technical solutions of the invention, each stage of compression unit comprises the movable member which is movably provided in the axial direction of the centrifugal compressor. The movable member of each stage of compression unit changes the flow area of the diffusion cavity of this stage of compression unit, thereby effectively reducing the possibility of surging.

BRIEF DESCRIPTION OF THE DRAWINGS

The specification drawings forming a part of the invention are intended to provide further understanding of the invention. The schematic embodiments and descriptions of the invention are intended to explain the invention, and do not form improper limits to the invention. In the drawings.

Drawing marks: 1, diffusion cavity; 21, movable member; 22, transmission rod; 23, bushing; 24, guide ring; 25, reset mechanism; 26, supporting belt; 251, baffle; 252, spring; 3, inlet guide blade; 4, transmission shaft; and 5, drive wheel.

DETAILED DESCRIPTION OF THE EMBODIMENTS

It is important to note that the embodiments of the invention and the characteristics in the embodiments can be combined under the condition of no conflicts. The invention is described below with reference to the drawings and the embodiments in detail.

Figure 1:
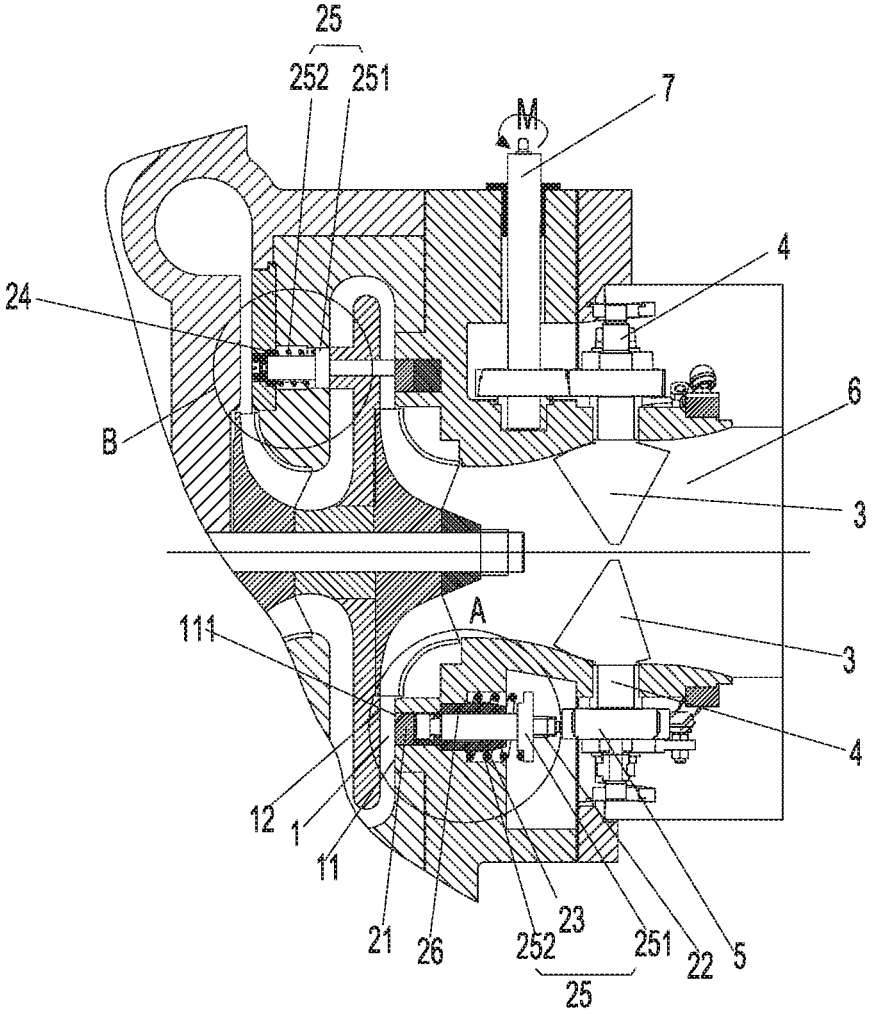
FIG. 1 shows a structural diagram of a centrifugal compressor according to an embodiment of the invention.

As shown in FIG. 1, a centrifugal compressor according to an embodiment of the invention comprises multiple stages of compression units which are communicated in sequence. Each stage of compression unit comprises a diffusion cavity 1 and a diffusion cavity adjustment device, wherein the diffusion cavity adjustment device comprises a movable member 21 configured to change a flow area of the diffusion cavity 1 provided in correspondence thereto, the movable member 21 being movably provided in an axial direction of the centrifugal compressor.

In the process that each movable member 21 moves in the axial direction of the centrifugal compressor, the flow area of the corresponding diffusion cavity 1 is changed. When a running load is reduced, a flow velocity of air can be increased by decreasing the flow area of each diffusion cavity 1, thereby effectively preventing the compressor from surging.

Each stage of diffusion cavity adjustment device further comprises a transmission rod 22 and a guide structure. Each transmission rod 22 is in drive connection with the corresponding movable member 21.

In the embodiment, each movable member 21 is fixedly connected with one end of the corresponding transmission rod 22. Each transmission rod 22 drives the corresponding movable member 21 to move in the axial direction of the centrifugal compressor.

Each guide structure is fixedly connected with a cavity wall of the corresponding diffusion cavity 1. Each transmission rod 22 is movably provided in the axial direction of the centrifugal compressor with respect to the corresponding guide structure.

Each guide structure is configured to guarantee that the corresponding transmission rod 22 moves in the axial direction of the centrifugal compressor with respect to the corresponding diffusion cavity 1. Furthermore, each guide structure reduces a friction force in a movement process of the corresponding transmission rod 22, improves the practicality of the corresponding diffusion cavity adjustment device, and prolongs the service life of this diffusion cavity adjustment device. Furthermore, the precision of this diffusion cavity adjustment device is effectively improved.

Each stage of diffusion cavity adjustment device further comprises a reset mechanism 25 configured to move the corresponding movable member 21 to make the flow area of the corresponding diffusion cavity 1 in a maximum state.

Each reset mechanism 25 provides a force F1 for the corresponding movable member 21 to move to a position where the flow area of the corresponding diffusion cavity 1 is in the maximum state. When the running load is reduced, each transmission rod 22 exerts a force F2 on the corresponding movable member 21 to make it move to a direction in which the flow area of the corresponding diffusion cavity is reduced. If F2 is greater than F1, each movable member 21 moves to the direction in which the flow area of the corresponding diffusion cavity is reduced.

Figure 2:
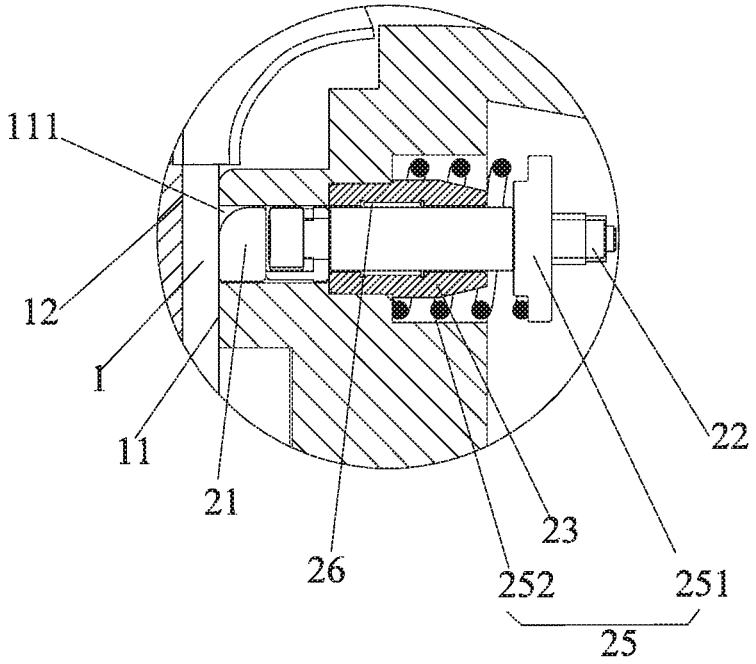
FIG. 2 shows a structural diagram of amplification of a point A in FIG. 1.

As shown in FIG. 2, in the embodiment, each diffusion cavity 1 is enclosed by a first cavity wall and a second cavity wall, the first cavity wall and the second cavity wall being provided at an interval. Each guide structure comprises a bushing 23 arranged at a periphery of the corresponding transmission rod 22 in a sleeving manner. Each bushing 23 is fixed inside an accommodating hole provided at the corresponding first cavity wall.

Each reset mechanism 25 comprises a baffle 251 and a spring 252. Each baffle 251 is connected with the corresponding transmission rod 22 and extends to a direction, away from this transmission rod 22, in a direction of this transmission rod 22. Each baffle 251 is connected to an end of the corresponding transmission rod 22.

Each spring 252 is arranged at a periphery of the corresponding bushing 23 in a sleeving manner. The accommodating hole on each first cavity wall comprises a first segment adapting to the corresponding bushing 23 and a second segment adapting to the corresponding spring 252.

Each spring 252 is located between a step surface, connecting the corresponding first segment and the corresponding second segment, and the corresponding baffle 251.

An accommodating slot is provided at an inner circumferential surface of each bushing 23. Each guide structure further comprises a supporting belt 26 arranged in the corresponding accommodating slot. Each supporting belt 26 is matched with the corresponding transmission rod 22 slidably.

Each accommodating slot is an annular slot which is provided at the inner circumferential surface of the corresponding bushing 23 and is coaxial with the corresponding transmission rod 22. Each supporting belt 26 arranged in the corresponding accommodating slot is in an annular shape adapting to this accommodating slot. An inner surface of each supporting belt 26 is higher than that of the corresponding bushing 23. Consequently, in the axial movement process of each transmission rod 22, this transmission rod 22 is only in contact with the inner surface of the corresponding supporting belt. The inner surface of each supporting belt 26 is a smooth surface, thereby effectively reducing a friction force in a movement process of the corresponding transmission rod 22.

When the running load is increased, each spring 252 drives the corresponding movable member 21 to move to a direction in which the flow area of the corresponding diffusion cavity is increased, thereby improving the working efficiency of the centrifugal compressor.

Each movable member 21 comprises a circular ring, the axis of the centrifugal compressor serving as a centre. A groove adapting to each circular ring is provided at the corresponding first cavity wall. Each accommodating hole has an opening which is provided at a bottom of the corresponding groove and allows the penetration of the corresponding transmission rod 22.

When each movable member 21 is completely located in the corresponding groove, the flow area of the corresponding diffusion cavity 1 is in the maximum state. In the process that each transmission rod 22 drives the corresponding movable member 21 to move to the corresponding second cavity wall in the axial direction of the centrifugal compressor, the flow area of the corresponding diffusion cavity 1 is gradually decreased.

Figure 3:
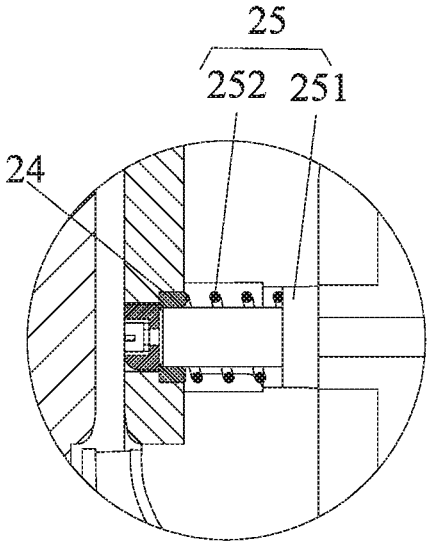
FIG. 3 shows a structural diagram of amplification of a point B in FIG. 1

Also preferably, as shown in FIG. 3, each guide structure comprises at least one guide ring 24 coaxial with the corresponding transmission rod 22. Each reset mechanism 25 comprises the baffle 251 and the spring 252. Each baffle 251 is connected with an end of the corresponding transmission rod 22. Each spring 252 is arranged outside the corresponding transmission rod 22 in a sleeving manner and is provided between the corresponding baffle 251 and a guide ring adjacent to this baffle 251.

Each diffusion cavity 1 is enclosed by a first cavity wall and a second cavity wall, the first cavity wall and the second cavity wall being provided at an interval. A accommodating hole is provided at the corresponding first cavity wall, and an outer circumferential surface of at least one guide ring 24 is connected with an inner circumferential surface of the accommodating hole.

In the embodiment, each reset mechanism comprises a guide ring 24 which is provided at one end, close to the corresponding second cavity wall, of the corresponding accommodating hole. Each spring 252 is arranged on the corresponding transmission rod 22 in a sleeving manner and is located between the corresponding guide ring 24 and the corresponding baffle 251.

Each guide ring 24 reduces the friction force in the movement process of the corresponding transmission rod. A path is provided for the movement of this transmission rod 22. The movement precision of each movable member 21 is guaranteed.

Each movable member 21 is annular. Each groove adapting to the corresponding movable member 21 is provided at the corresponding first cavity wall. Each accommodating hole has an opening which is provided at a bottom of the corresponding groove.

When each movable member 21 is completely located in the corresponding groove, the flow area of the corresponding diffusion cavity 1 is in the maximum state. In the process that each transmission rod 22 drives the corresponding movable member 21 to move to the corresponding second cavity wall in the axial direction of the centrifugal compressor, the flow area of the corresponding diffusion cavity 1 is gradually decreased.

When the running load is increased, each spring 252 drives the corresponding movable member 21 to move to a direction in which the flow area of the corresponding diffusion cavity is increased, thereby improving the working efficiency of the centrifugal compressor.

When the running load is reduced, each transmission rod 22 drives the corresponding movable member 21 to move to a direction in which the flow area of the corresponding diffusion cavity is decreased, so that the flow velocity of the air is increased by decreasing the flow area of each diffusion cavity 1, thereby effectively preventing the centrifugal compressor from surging.

The centrifugal compressor further comprises a drive device, an air inlet, a plurality of inlet guide blades 3 and a plurality of transmission shafts. The inlet guide blades 3 are provided at the air inlet. The drive device is in drive connection with the inlet guide blades 3.

Each of the transmission shafts 4 are in drive connection with the drive device respectively, and the transmission shafts 4 are in drive connection with the inlet guide blades 3 in a one-to-one correspondence manner. The transmission rod 22 of a compression unit closest to the air inlet is in transmission connection with one of the corresponding transmission shafts 4, and the transmission rod 22 of each of the remaining stages of compression units is in transmission connection with the movable member 21 of the previous stage of compression unit.

The inlet guide blades 3 rotate with respect to the air inlet in axial directions of the transmission shafts 4 along with the rotation of the transmission shafts. In the rotation process of the inlet guide blades 3, the air inflow of the air inlet of the centrifugal compressor is changed, thereby changing the running load of the centrifugal compressor.

The centrifugal compressor further comprises at least one drive wheel 5. The drive wheel 5 sleeves the corresponding transmission shaft 4 and is arranged in correspondence to one certain transmission rod 22.

The drive wheel 5 is a cam or an eccentric bearing. A first end of the corresponding transmission rod 22 of the drive wheel 5 abuts against an outer circumferential surface of the drive wheel 5. A second end of the corresponding transmission rod 22 of the drive wheel 5 is connected with the corresponding movable member 21.

In the process that each inlet guide blade 3 rotates to a direction in which the air inflow of the centrifugal compressor is decreased, the corresponding drive wheel rotates, a distance from an abutting point between this drive wheel and the corresponding transmission rod 22 to an axis of the corresponding transmission shaft 4 is gradually increased, and this drive wheel drives the corresponding movable member 21 to move to a direction in which the flow area of the corresponding diffusion cavity 1 is decreased via this transmission rod 22.

In the process that each inlet guide blade 3 rotates to a direction in which the air inflow of the centrifugal compressor is increased, the corresponding drive wheel rotates, a distance from an abutting point between this drive wheel and the corresponding transmission rod 22 to an axis of the corresponding transmission shaft 4 is gradually decreased, and this transmission rod 22 drives the corresponding movable member 21 to move to a direction in which the flow area of the corresponding diffusion cavity 1 is increased under the driving of the corresponding spring 252.

According to another aspect of the invention, a centrifugal unit is also provided, which comprises an above-mentioned centrifugal compressor.

The above is only the preferred embodiments of the invention, and is not intended to limit the invention. There can be various modifications and variations in the invention for those skilled in the art. Any modifications, equivalent replacements, improvements and the like within the spirit and principle of the invention shall fall within the protection scope of the invention.

The invention claimed is:

1. A centrifugal compressor, comprising multiple stages of compression units which are communicated in sequence, each stage of compression unit comprising:

a diffusion cavity (1); and a diffusion cavity adjustment device, the diffusion cavity adjustment device comprising a movable member (21) configured to change a flow area of the diffusion cavity (1) provided in correspondence thereto, and the movable member (21) being movably provided in an axial direction of the centrifugal compressor;

wherein each stage of diffusion cavity adjustment device further comprises:

a transmission rod (22), the transmission rod (22) being in drive connection with a corresponding movable member (21); and a guide structure, fixedly connected with a cavity wall of the corresponding diffusion cavity (1), the transmission rod (22) being movably provided in the axial direction of the centrifugal compressor with respect to the guide structure;

wherein each stage of diffusion cavity adjustment device further comprises a reset mechanism (25) provides a force for the corresponding movable member (21) to move to a position where the flow area of the corresponding diffusion cavity (1) is in a maximum state;

wherein each diffusion cavity (1) is enclosed by a first cavity wall and a second cavity wall, the first cavity wall and the second cavity wall being provided at an interval; and each guide structure comprises a bushing (23) arranged at the periphery of a corresponding transmission rod (22) in a sleeving manner, the bushing (23) being fixed inside an accommodating hole provided at the corresponding first cavity wall; and wherein each reset mechanism (25) comprises:

a baffle (251), connected with an end of the corresponding transmission rod (22); and a spring (252), arranged at a periphery of a corresponding bushing (23) in a sleeving manner, each accommodating hole on a corresponding first cavity wall comprises a first segment adapting to the corresponding bushing (23) and a second segment adapting to a corresponding spring (252), and the spring (252) being located between a step surface, connecting the first segment and the second segment, and the baffle (251).

2. The centrifugal compressor according to claim 1, wherein each movable member (21) comprises a circular ring, an axis of the centrifugal compressor serving as a centre; a groove adapting to each circular ring is provided at the corresponding first cavity wall; and each accommodating hole has an opening which is provided at a bottom of the corresponding groove and allows the penetration of the corresponding transmission rod (22).

3. The centrifugal compressor according to claim 1, wherein an accommodating slot is provided at an inner circumferential surface of each bushing (23); and each guide structure further comprises a supporting belt (26) provided in the corresponding accommodating slot, the supporting belt (26) being matched with the corresponding transmission rod (22) slidably.

4. The centrifugal compressor according to claim 3, further comprising:

an air inlet;

a plurality of inlet guide blades (3), provided at the air inlet;

a drive device, the drive device being in drive connection with the inlet guide blades (3); and a plurality of transmission shafts (4), each of the transmission shafts (4) being in drive connection with the drive device respectively, the transmission shafts (4) being in drive connection with the inlet guide blades (3) in a one-to-one correspondence manner, the transmission rod (22) of a compression unit closest to the air inlet being in transmission connection with one of a corresponding transmission shafts (4), and the transmission rod (22) of each remaining stages of compression units being in transmission connection with the movable member (21) of a previous stage of compression unit.

5. The centrifugal compressor according to claim 1, further comprising:

an air inlet;

a plurality of inlet guide blades (3), provided at the air inlet;

a drive device, the drive device being in drive connection with the inlet guide blades (3); and a plurality of transmission shafts (4), each of the transmission shafts (4) being in drive connection with the drive device respectively, the transmission shafts (4) being in drive connection with the inlet guide blades (3) in a one-to-one correspondence manner, the transmission rod (22) of a compression unit closest to the air inlet being in transmission connection with one of a corresponding transmission shafts (4), and the transmission rod (22) of each remaining stages of compression units being in transmission connection with the movable member (21) of a previous stage of compression unit.

6. The centrifugal compressor according to claim 5, further comprising at least one drive wheel (5), wherein the drive wheel (5) sleeves the corresponding transmission shaft (4) and is provided in correspondence to one transmission rod (22).

7. The centrifugal compressor according to claim 6, wherein the drive wheel (5) is a cam or an eccentric bearing; a first end of the corresponding transmission rod (22) of the drive wheel (5) abuts against an outer circumferential surface of the drive wheel (5); and a second end of the corresponding transmission rod (22) of the drive wheel (5) is connected with the corresponding movable member (21).

8. A centrifugal unit, comprising the centrifugal compressor according to claim 1.

9. A centrifugal compressor, comprising multiple stages of compression units which are communicated in sequence, each stage of compression unit comprising:

a diffusion cavity (1); and a diffusion cavity adjustment device, the diffusion cavity adjustment device comprising a movable member (21) configured to change a flow area of the diffusion cavity (1) provided in correspondence thereto, and the movable member (21) being movably provided in an axial direction of the centrifugal compressor;

wherein each stage of diffusion cavity adjustment device further comprises:

a transmission rod (22), the transmission rod (22) being in drive connection with a corresponding movable member (21); and a guide structure, fixedly connected with a cavity wall of the corresponding diffusion cavity (1), the transmission rod (22) being movably provided in the axial direction of the centrifugal compressor with respect to the guide structure;

wherein each stage of diffusion cavity adjustment device further comprises a reset mechanism (25) provides a force for the corresponding movable member (21) to move to a position where the flow area of the corresponding diffusion cavity (1) is in a maximum state;

wherein, each guide structure comprises at least one guide ring (24) coaxial with a corresponding transmission rod (22); and wherein each reset mechanism (25) comprises:

a baffle (251), connected with an end of the corresponding transmission rod (22); and a spring (252), arranged outside the corresponding transmission rod (22) in a sleeving manner and provided between the baffle (251) and the guide ring (24) adjacent to the baffle (251).

10. The centrifugal compressor according to claim 9, wherein each diffusion cavity (1) is enclosed by a first cavity wall and a second cavity wall, the first cavity wall and the second cavity wall being provided at an interval; a accommodating hole is provided at the corresponding first cavity wall; and an outer circumferential surface of the at least one guide ring (24) is connected with an inner circumferential surface of the corresponding accommodating hole.

11. The centrifugal compressor according to claim 10, wherein each movable member (21) is annular; a groove adapting to each movable member (21) is provided at the corresponding first cavity wall; and each accommodating hole has an opening which is provided at a bottom of the corresponding groove.

12. The centrifugal compressor according to claim 9, further comprising:

an air inlet;

a plurality of inlet guide blades (3), provided at the air inlet;

a drive device, the drive device being in drive connection with the inlet guide blades (3); and a plurality of transmission shafts (4), each of the transmission shafts (4) being in drive connection with the drive device respectively, the transmission shafts (4) being in drive connection with the inlet guide blades (3) in a one-to-one correspondence manner, the transmission rod (22) of a compression unit closest to the air inlet being in transmission connection with one of a corresponding transmission shafts (4), and the transmission rod (22) of each remaining stages of compression units being in transmission connection with the movable member (21) of a previous stage of compression unit.

* * * * *